US006699158B1

(12) United States Patent
Richardson et al.

(10) Patent No.: US 6,699,158 B1
(45) Date of Patent: Mar. 2, 2004

(54) PIVOTING CLIMBING AND TRAVERSING STRUCTURE

(75) Inventors: Howard B Richardson, Cambridge, MA (US); George Warren Brewer, Newton, MA (US)

(73) Assignee: Brewer's Ledge, Inc., Boston, MA (US)

( * ) Notice: Subject to any disclaimer, the term of this patent is extended or adjusted under 35 U.S.C. 154(b) by 10 days.

(21) Appl. No.: 09/657,373

(22) Filed: Sep. 8, 2000

Related U.S. Application Data

(60) Provisional application No. 60/152,729, filed on Sep. 8, 1999.

(51) Int. Cl.[7] ..... A63B 7/00; B65G 17/06

(52) U.S. Cl. ..... 482/37; 198/850

(58) Field of Search ..... 482/37, 36, 51, 482/38, 35, 116; 40/430; 198/850; 434/247; 52/591.4, 86, 245

(56) References Cited

U.S. PATENT DOCUMENTS

| | | | | | |
|---|---|---|---|---|---|
| 239,970 | A | * | 4/1881 | Medart | 482/106 |
| 3,814,416 | A | | 6/1974 | Munger et al. | 272/56.5 R |
| 4,097,043 | A | | 6/1978 | Rudy | 272/113 |
| 4,546,965 | A | | 10/1985 | Baxter et al. | 272/56.5 R |
| 4,603,853 | A | | 8/1986 | Satterthwaite | 272/113 |
| 5,125,877 | A | * | 6/1992 | Brewer | 482/37 |
| 5,177,926 | A | | 1/1993 | Frankel | 52/655.1 |
| 5,254,058 | A | | 10/1993 | Savigny | 482/37 |
| 5,256,116 | A | | 10/1993 | Robinson | 402/37 |
| 5,330,400 | A | | 7/1994 | Huberman | 482/35 |
| 5,437,573 | A | | 8/1995 | Rodriguezferre | 472/116 |
| 5,549,195 | A | * | 8/1996 | Aulagner et al. | 482/37 |
| 5,816,980 | A | | 10/1998 | Myszka et al. | 482/35 |
| 5,865,680 | A | | 2/1999 | Briggs | 472/128 |
| 5,919,117 | A | * | 7/1999 | Thompson et al. | 482/37 |
| 5,938,566 | A | | 8/1999 | Rodriguez-Ferre | 482/35 |
| 5,941,041 | A | | 8/1999 | Robinson et al. | 52/591.4 |
| 6,082,386 | A | | 7/2000 | Zheng | 135/126 |
| 6,095,950 | A | | 8/2000 | Katz | 482/35 |

* cited by examiner

*Primary Examiner*—Stephen R. Crow
(74) *Attorney, Agent, or Firm*—Kurt Rauschenbach; Rauschenbach Patent Law Group, LLC

(57) ABSTRACT

A climbing-traversing wall, designed to be installed as one of a group, is constructed with two opposite-facing surfaces positioned about a vertical axis such that the climbing wall may be pivoted about its central axis thus allowing the group of climbing walls to be adjusted to a variety of maze-like configurations.

23 Claims, 10 Drawing Sheets

PIVOTING CLIMBING AND TRAVERSING STRUCTURE

CROSS-REFERENCE TO RELATED APPLICATION

This patent application claims priority to U.S. provisional patent application Serial No. 60/152,729 that was filed on Sep. 8, 1999, the entire disclosure of which is incorporated herein by reference.

BACKGROUND

1. Field of Invention

This invention relates to playground equipment, specifically equipment for the activities of climbing and traversing.

2. Description of Prior Art

The activity of climbing has gained a great deal of popularity in the last few years, and as a result, there is a demand for safe and versatile climbing structures for use in public places such as school playgrounds, municipal facilities etc. Several manufacturers produce climbing structures, but in most cases they are either too high to be safe for unattended use, or they are lacking in versatility and adaptability.

Climbing structures fall into two general categories—skeletal structures and featured surface structures. In the first category are found the traditional jungle gym and rambling structures such as Munger #3814416 as well as geometric structures such as Rudy #4097043 and Safferthwaite #4603853. Another type of skeletal climber uses flexible climbing elements such as rope ladders and Huberman #5330400. This skeletal type of equipment provides a kind of 'tree climbing' environment where the user grasps the ladder-like climbing elements with the full hand and ascends or swings from point to point—a type of climbing that is fundamentally different from 'rock-climbing' where the user grasps protrusions or indented features on a flat or undulating surface. In the second category of featured surface structures are found large-scale walls such as Savigny #5254058 which for safety reasons are not suitable for playground use, smaller units such as Robinson #5941041 and Baxter #4546965 which are limited in variety and adaptability, and panels added onto larger structures such as Zheng #6082386 and Katy #6095950 which are generally too small for an extended climbing experience and also lack variety.

OBJECTS AND ADVANTAGES

Accordingly, the present invention, which in this document we call the 'climbing unit', offers several objects and advantages which are:

(a) to provide a climbing environment of the 'rock climbing' type with featured surfaces and a maze-like structure that can be easily altered to a new plan, thus providing variety and continued interest;

(b) to provide a climbing environment with a large climbing area that is of limited height and promotes traversing (sideways climbing) thus providing for an extended safe climbing experience;

(c) to provide a climbing unit that is modular and can be installed in groups of various numbers in order to provide an appropriately-sized climbing facility;

(d) to provide a climbing environment that is suitable for childhood games, such as tag, hide-and-seek, and follow-the-leader;

(e) to provide a climbing environment that can be adapted to various types of climbing style, such as is found with rope climbing and jungle gyms as well as featured-wall climbing;

(f) to provide a playground facility that is visually attractive and presents a dramatic sculptural appearance that changes with the angular adjustment of the climbing units;

(g) to provide a climbing unit that can be easily pivoted to different orientations, but can be locked into a desired orientation if required to prevent unauthorized tampering.

DRAWING DESCRIPTIONS

PARTS LIST

Figure 1:
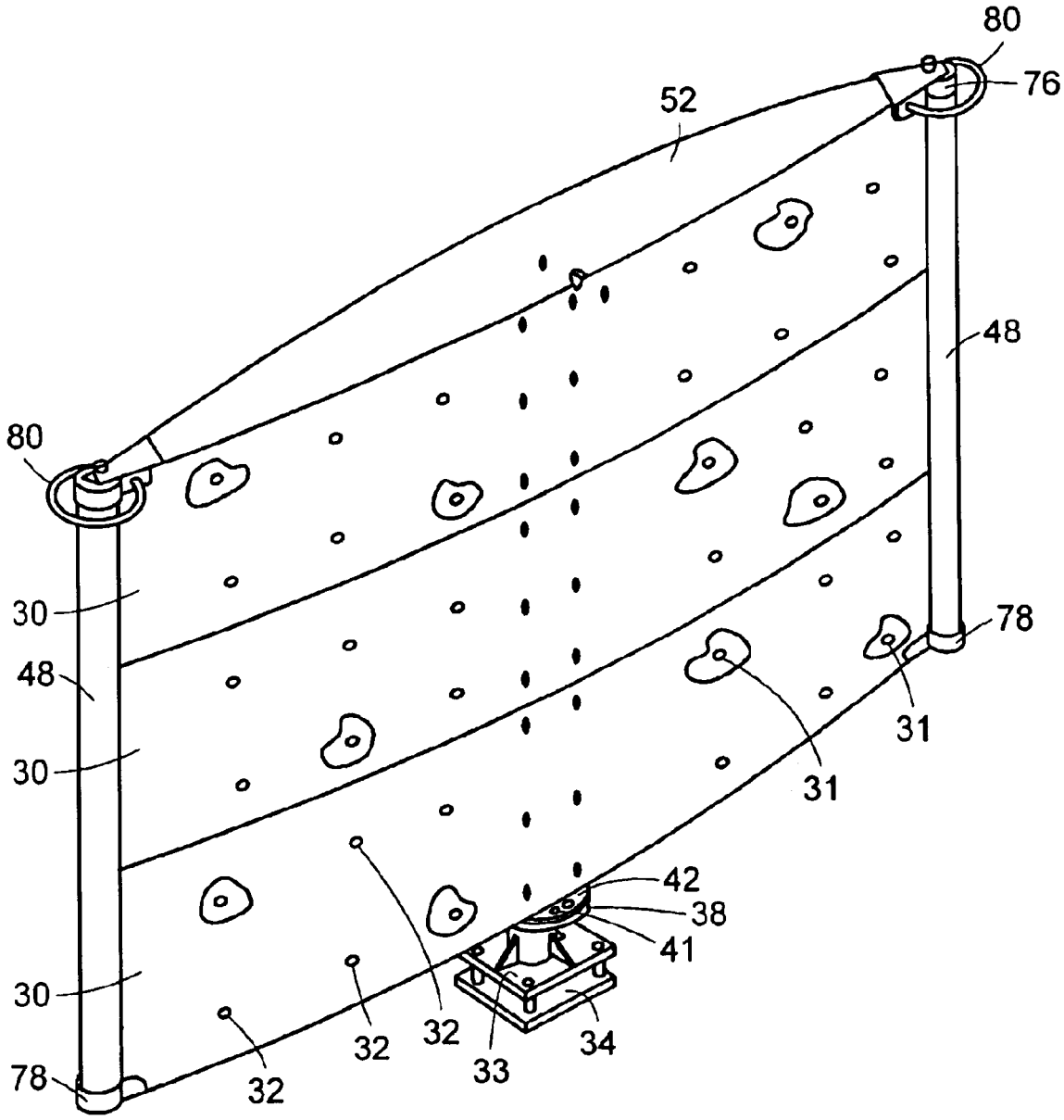
FIG. 1 shows a complete climbing unit in perspective.

(30) Climbing panels
(31) Climbing holds
(32) Panel threaded inserts for climbing holds
(33) Base plate
(34) Foundation plate
(36) Foundation unit
(38) Locking ring
(40) Locking ring holes
(41) Locking flange holes
(42) Locking flange
(47) Tension rod nuts
(48) Slotted clamping tubes
(49) Slotted clamping tubes for use with grooved panels
(50) Slotted clamping tubes for use with band clamps
(51) Bracket
(52) Cap
(53) Cap end
(58) Support pipe
(60) Sleeve
(62) Panel mounting flanges
(64) Panel mounting threaded inserts
(66) Tension rod attachments
(68) Tension rods
(70) Clamp tabs

(72) Friction clamp
(74) Clamping tube washers
(76) Upper clamping tube end
(78) Lower clamping tube end
(80) Grab ring
(82) Grooved flange
(84) Grooved ring
(86) Grooved flange holes
(88) Clamping channels
(90) Clamping channel bolts
(92) Short clamping channels
(94) Panel groove
(95) Panel with groove
(96) Panel hole for band-clamp
(97) Panel with band-clamp hole
(98) Band-clamp
(100) Group of climbing units—plan view

DESCRIPTION OF THE INVENTION

FIG. 1 shows a single climbing unit in a preferred embodiment Each climbing panel is made up of three narrow horizontally disposed panels (30) that are attached to a central pivoting core yielding a climbing surface of 8 ft. width and 6 ft. height. A second set of climbing panels is attached to the other side of the climbing unit, providing a second surface similar to the one shown.

The main 4" diameter support pipe (58) is attached to a base-plate (33) which bolts onto a matching plate (34) on the foundation unit (36) which is designed to be imbedded into concrete. A steel locking ring (38) with axial holes (40) around its circumference is attached to the support pipe near the bottom. A matching locking flange (42) that is attached to the inner structure of the wall, rests on the locking ring.

Slotted clamping tubes (48) at the ends of the panels (30) hold the ends of the panels together and give the panels a convex shape. A roof-like cap (52) held in place by a bracket FIG. 2 (51) and cap ends (53) finishes off the top of the climbing unit and grab-rings (54) are attached at the top ends (56) of the two clamp-tube assemblies.

Figure 2:
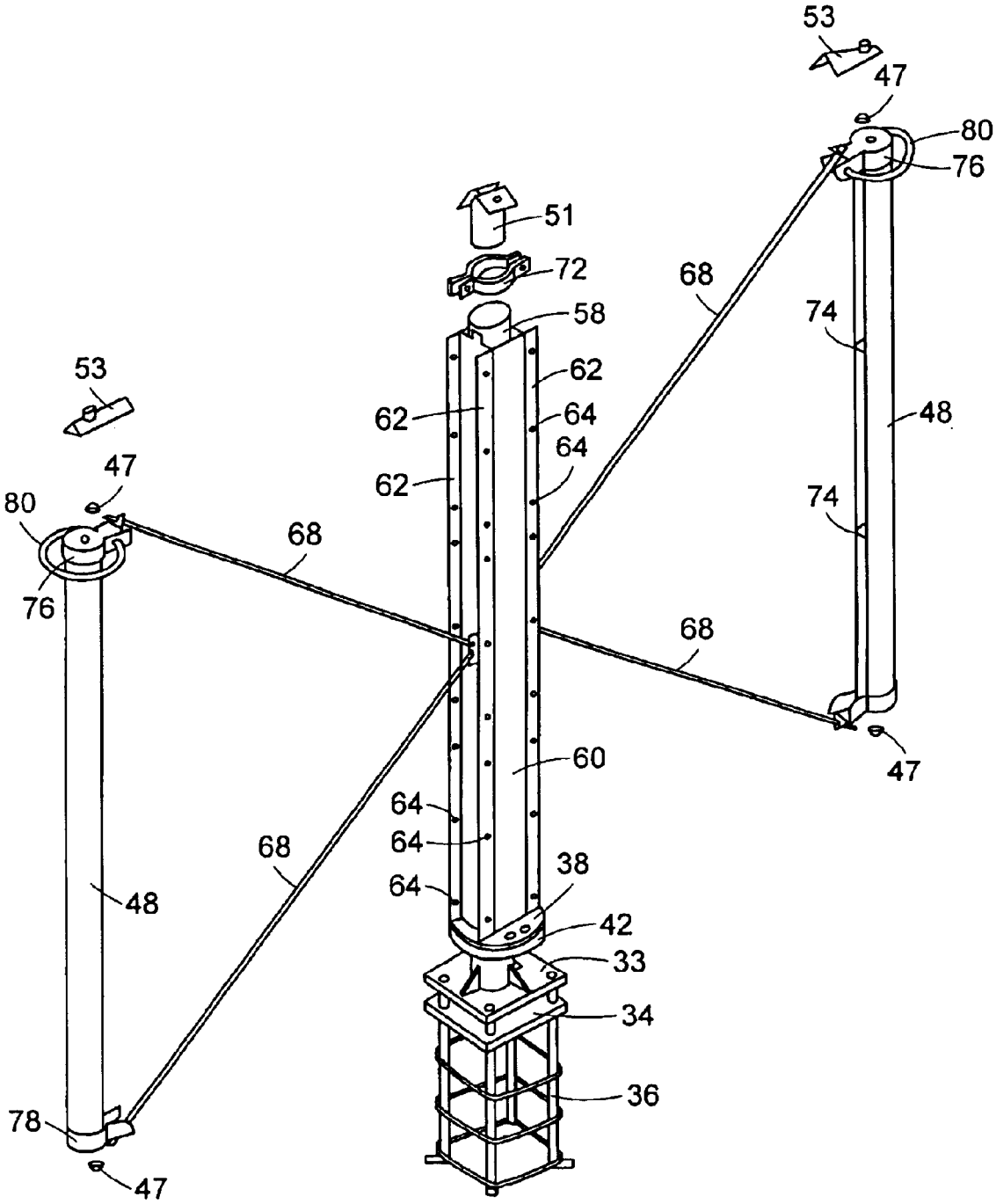
FIG. 2 shows a climbing unit with the panels removed to reveal the inner construction.

FIG. 2 shows a view with the climbing panels removed to show the interior construction. A foundation member (36) suitable to be imbedded-into a concrete foundation provides a horizontal plate (34) close to the foundation suitable for mounting the upper framework. The upper framework consists of a vertical pipe 4" in diameter (58) with a mounting plate (33) attached to its lower end. A steel ring (38) with axial holes evenly distributed around its circumference is attached to the vertical pipe above the mounting plate.

A close-fitting sleeve of square cross-section (60) is slipped over the vertical pipe and is free to rotate upon it. At the bottom of the sleeve, a horizontal flange (42) is attached that approximately matches the diameter of the steel ring (38) with axial holes. Holes are provided in the flange, spaced so as to match up with the holes in the steel ring at regular intervals of rotation. This allows a padlock or other device to be used to lock the angle of the wall after adjustment.

Figure seven shows the locking ring (38) and locking flange (42) in more detail. The locking ring is provided with holes (40) regularly disposed around its circumference, and the locking flange has holes (41) that alternately match up with the locking-ring holes. Eight holes in the locking ring and four holes in the locking flange will, for example, provide 32 unique angles of adjustment.

Flanges (62) with threaded inserts (64) are attached to the vertical corners of the sleeve (60) in such manner that the threaded inserts face outward from opposite sides of the sleeve, allowing the attachment of panels to these opposite vertical faces of the sleeve. Two attachment points (66) are provided about half-way up the sleeve on each of the two surfaces that are perpendicular to the climbing panels for flexible attachment of the tension rods (68). These rods have threaded ends to be attached to the outside corners of the wall.

Figure 3:
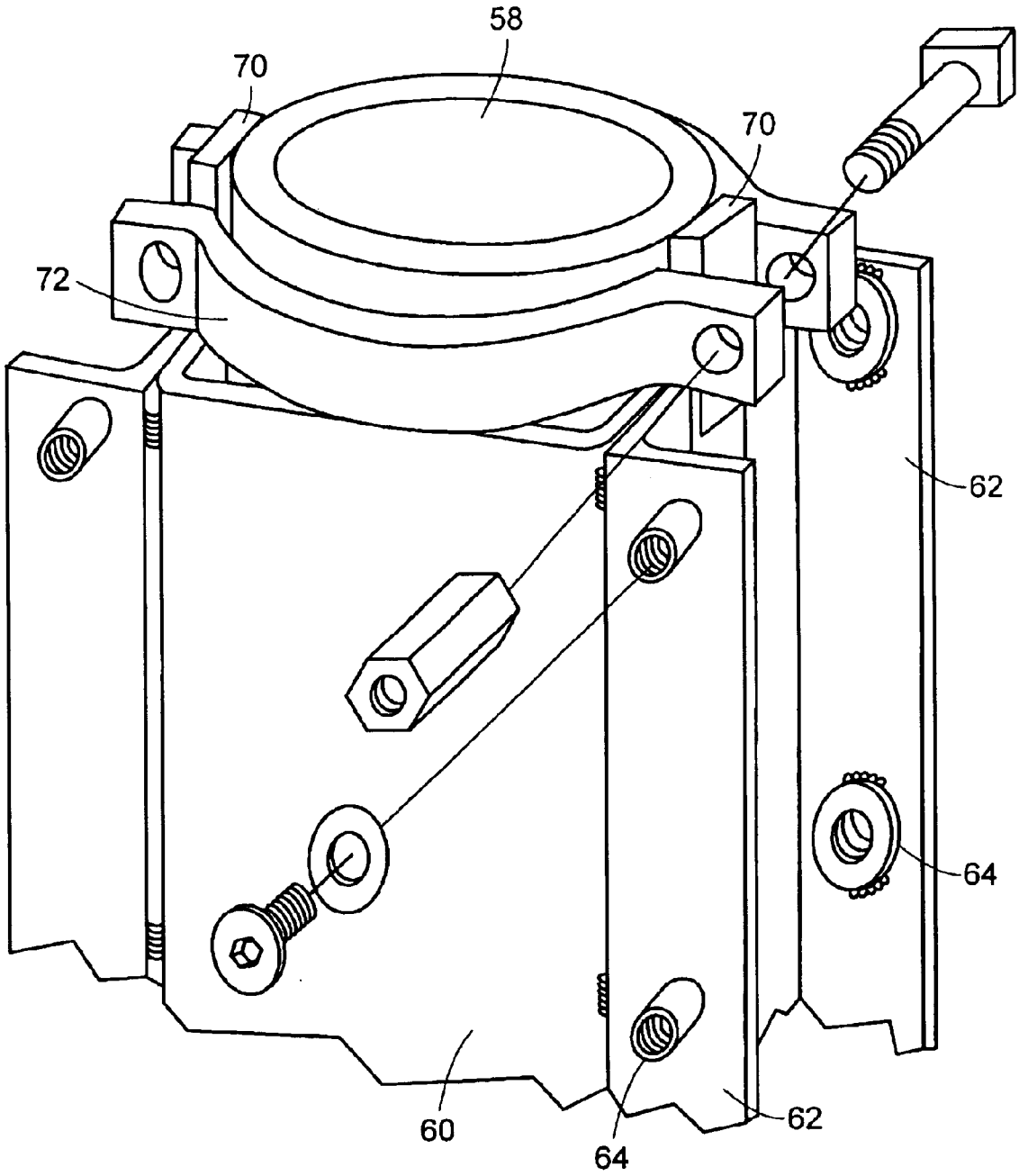
FIG. 3 shows a detail of the top end of the panel support assembly.

FIG. 3 shows a detail of the top of the sleeve. Two upward facing tabs (70) engage a clamp (72) that is a close fit around the central tube. By tightening this clamp, friction can be applied to the pipe, controlling horizontal wobbling of the wall during use.

The panels, FIG. 1 (30), are attractively surfaced and equipped with climbing holds (31), rocklike protrusions that are bolted into threaded inserts. Extra inserts (32) in the panels enable re-positioning of the holds. The panels in the drawings are 8 ft. wide and 2 ft. tall. Three panels on each side of the Wingwall make up a climbing surface 6 ft. tall by 8 ft. wide. The panels are drilled to match the threaded inserts FIG. 2 (64) on the vertical sleeve, where they are put in place and bolted on. At this point, the ends of the two sets of panels are spaced about 6 in. apart. Using appropriate tools, the ends are pulled together until they meet, and the slotted clamping-tubes FIG. 2 (48) are slipped over the ends to hold them together. This draws the climbing panels into a convex shape that presents a strong and rigid climbing surface.

Figure 4:
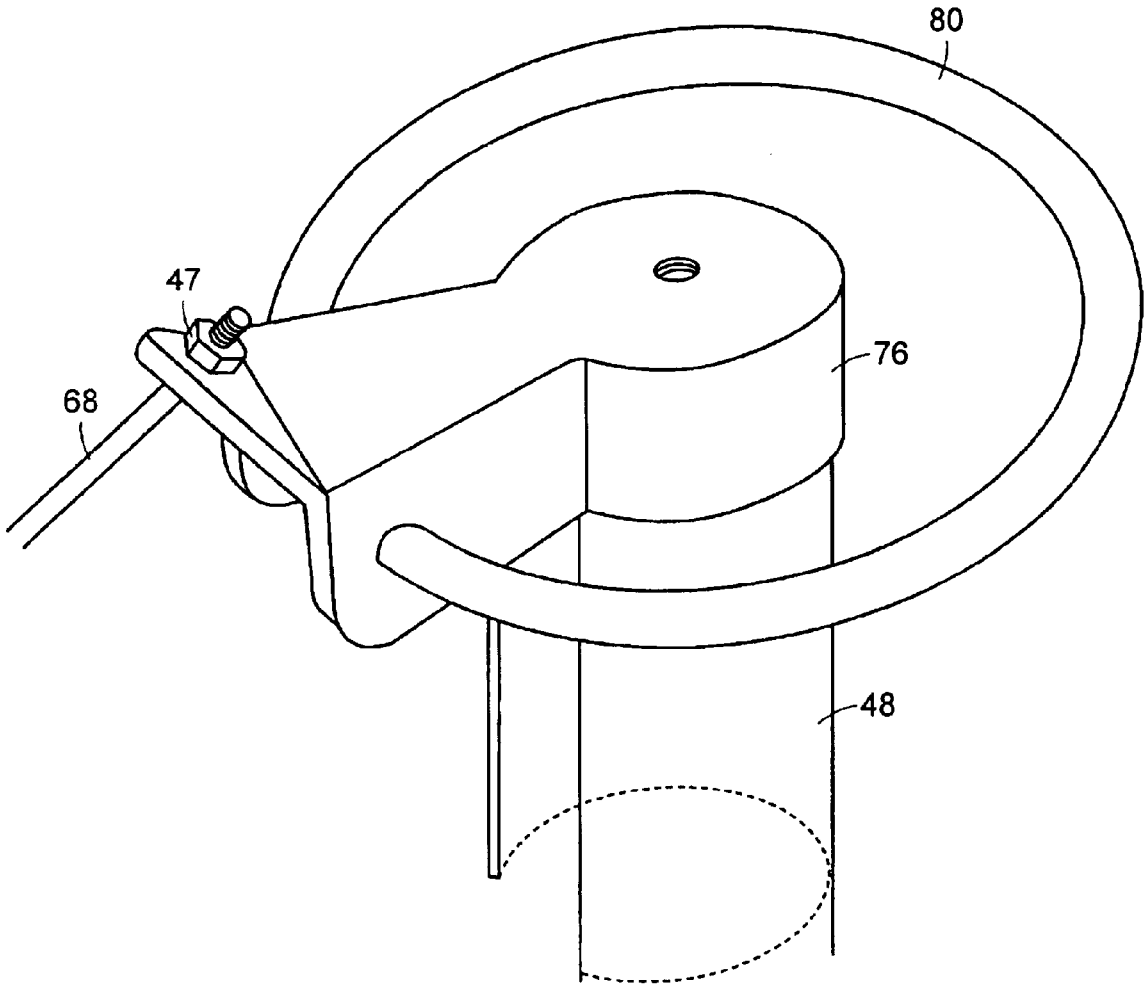
FIG. 4 shows the top end of one clamping-tube.

The slotted clamping tubes (48) as seen in FIG. 2 and FIG. 4 have several features. Spacing washers (74) attached to the inside of the tubes at the two points where the panel sections meet add strength to the tubes and prevent them from spreading due to the outward pressure of the panel ends. Units (76) and (78) attached to the ends of the tubes also prevent spreading and also provide appropriately angled holes for attachment of the tension rods. The upper end pieces (76) also provide an attachment point for a grab ring (80) that makes it easier for climbers to traverse from one panel to another.

The four tension rods (68) are attached with a flexible attachment to the center of the inner rotating sleeve, and are long enough to reach the corners of the wall. The outer ends of the rods are threaded. These rods form a dual function of holding the clamping-tubes (48) in place and providing vertical strength to the cantilevered ends of the wall. The clamping tubes have ends with appropriately angled holes (49) for the rods. As the clamping tubes are slipped onto the ends of the wall, the rods are directed through the holes in the ends of the clamping tubes and nuts (47) are screwed on hold the tubes in place.

Figure 5:
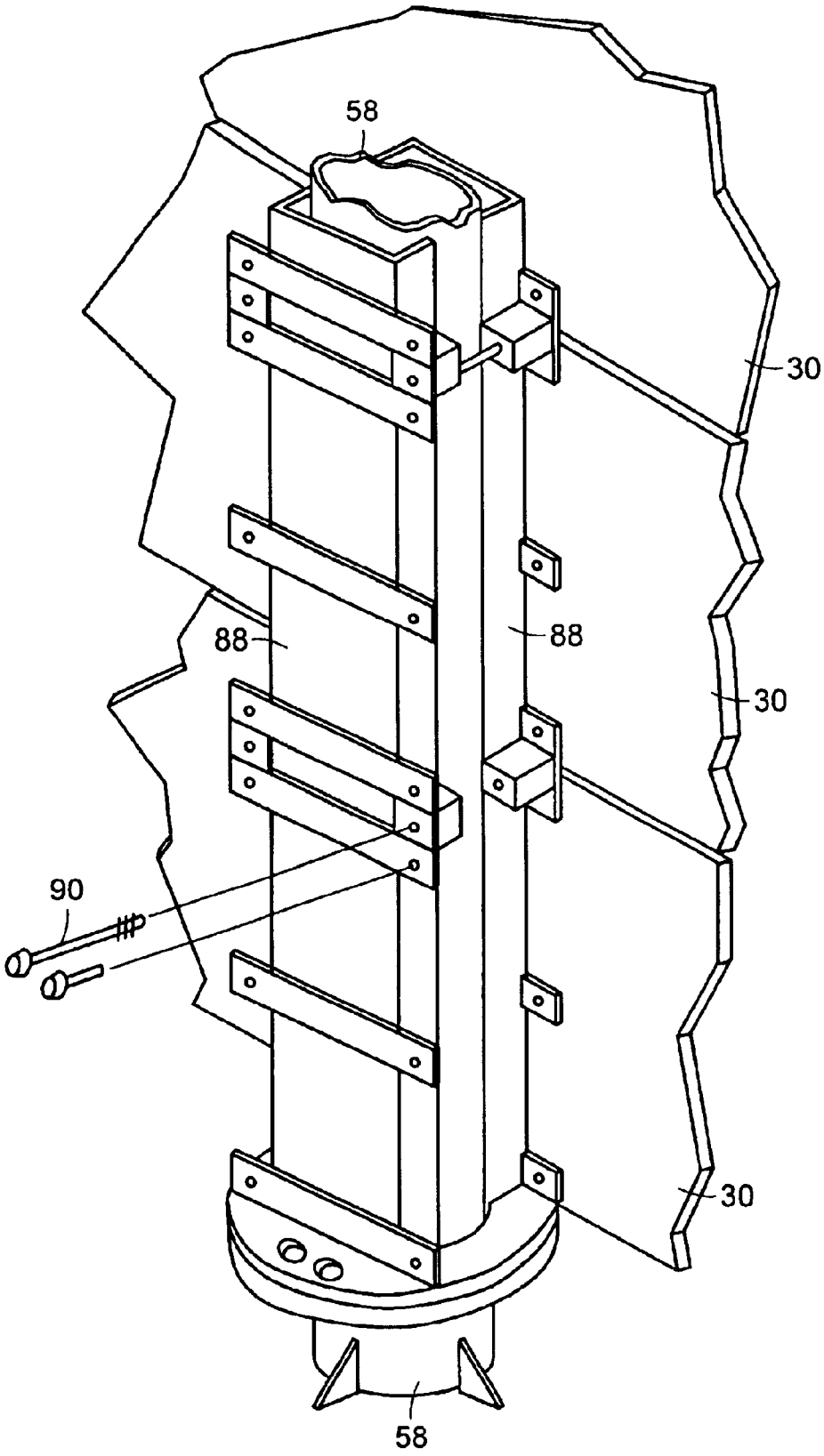
FIG. 5 shows an alternative method of mounting the panels on the central support pipe.
Figure 6:
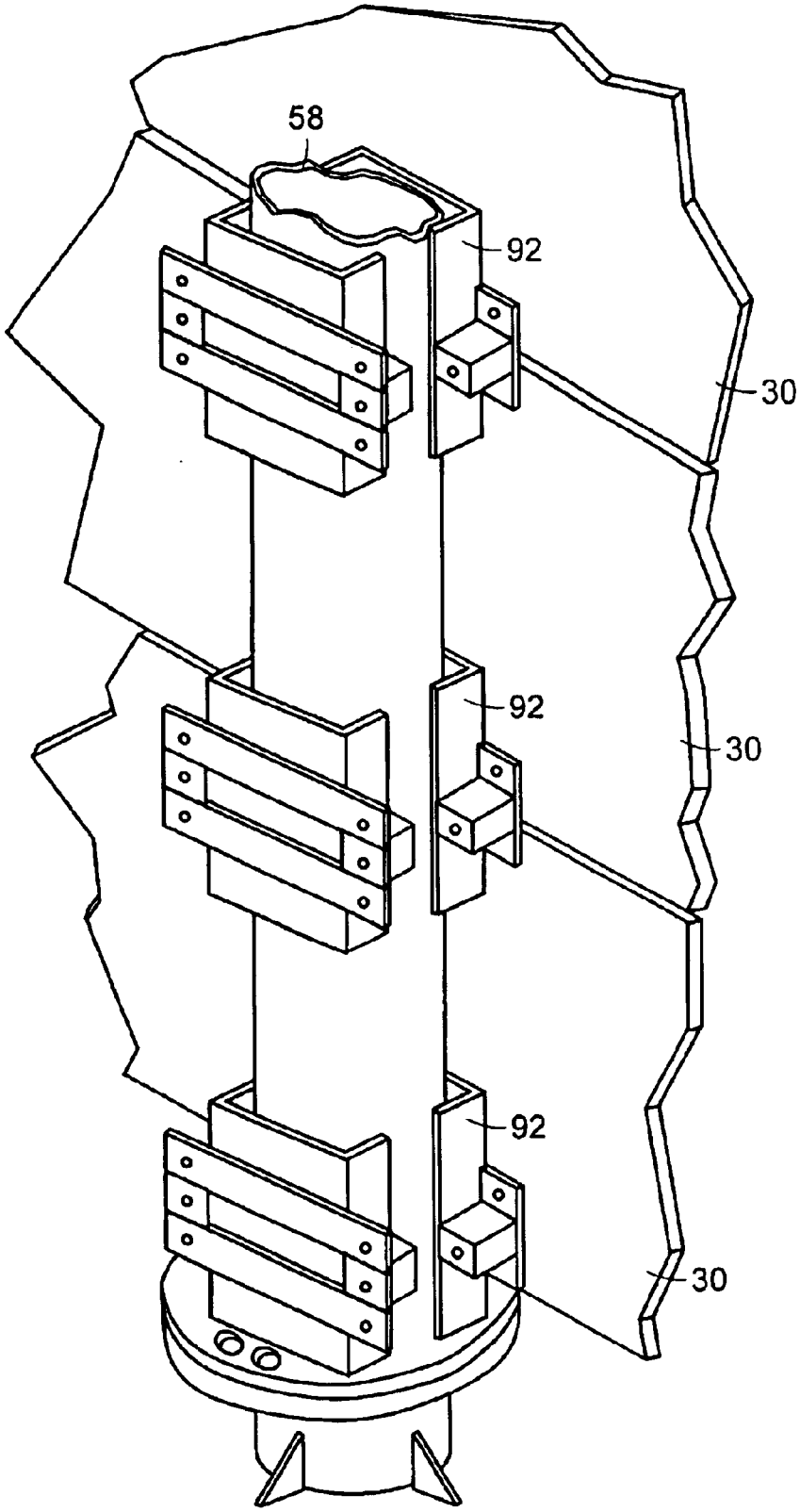
FIG. 6 shows another alternative method for mounting the panels.
Figure 7:
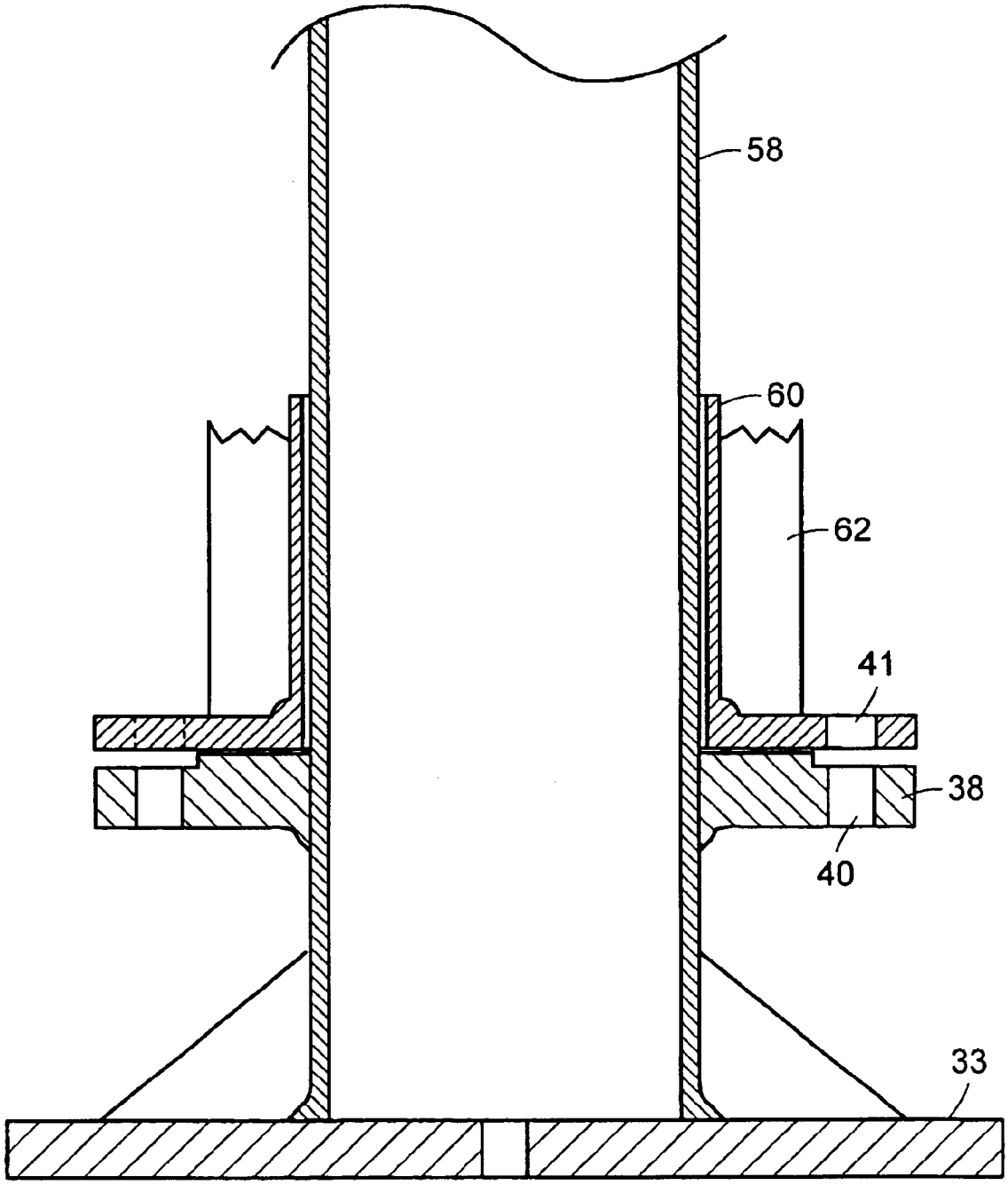
FIG. 7 shows the locking ring and locking flange in more detail.
Figure 8:
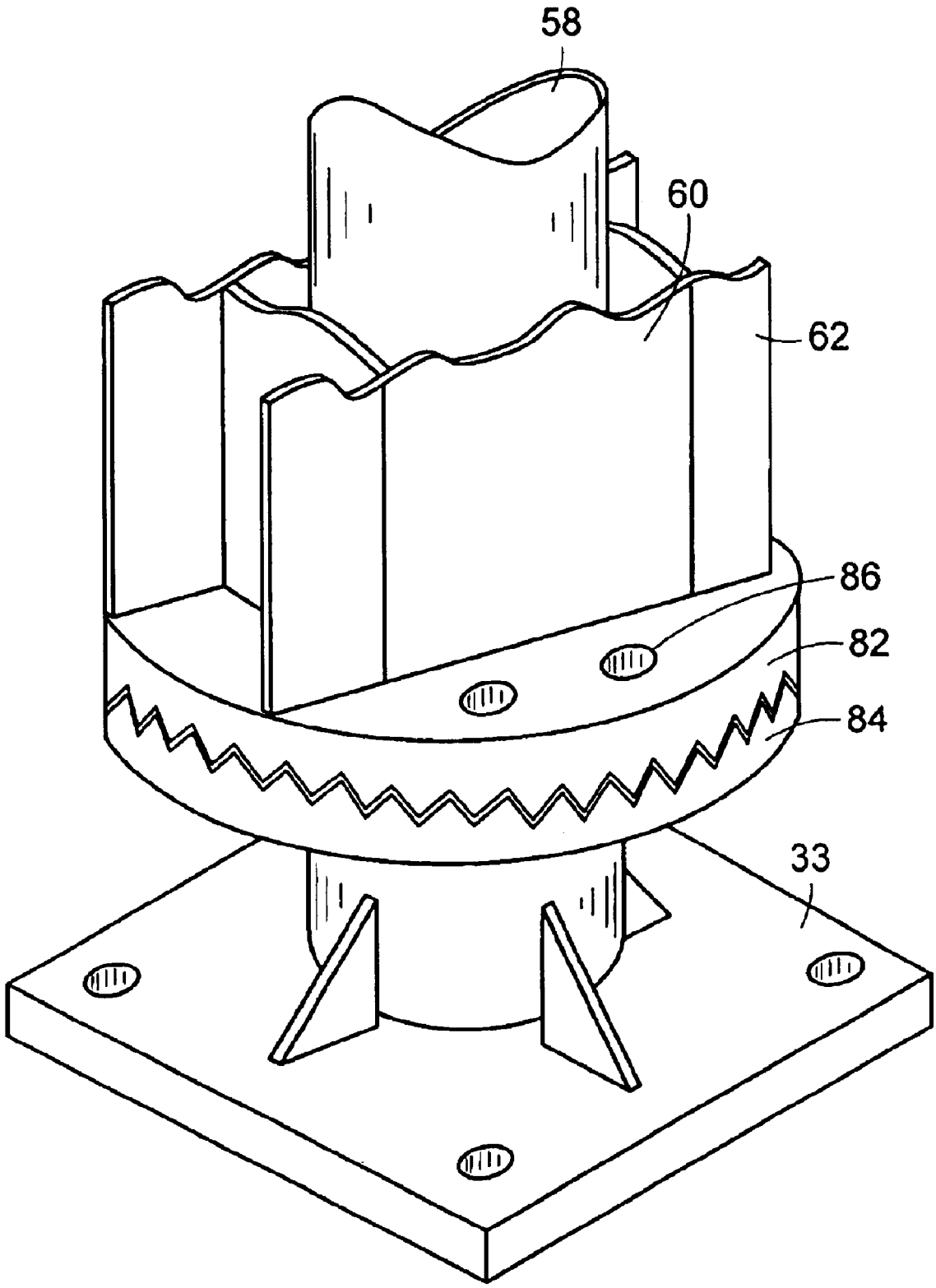
FIG. 8 shows an alternative method locking the rotation of the wall.

The clamping and locking functions of the wall are important to its functioning, and several other means are available. FIG. 8 shows one concept that uses rings with matching grooved surfaces. As the wall is adjusted, the flange (82) would ride up on the ring (84) and then lower into the next groove. These rings could be provided with locking holes (86) as well. If such rings were made with a close enough fit, the need for additional clamping could be eliminated. Another concept, shown in FIG. 5 is to change the rotating inner sleeve to a pair of channels (88) that face into the pipe and clamp onto it with externally adjustable bolts (90). These provide a very strong clamping force—enough to eliminate the need for locking rings in some settings. FIG. 6 shows yet another method for mounting the panels. In this plan, the long channels (88) in FIG. 5 are replaced with short sections of channel (92) that are disposed at the edges of the panels, thus requiring less material. As with the longer channels, these channels may also be clamped tightly around the support pipe (58) to provide friction.

Figure 9:
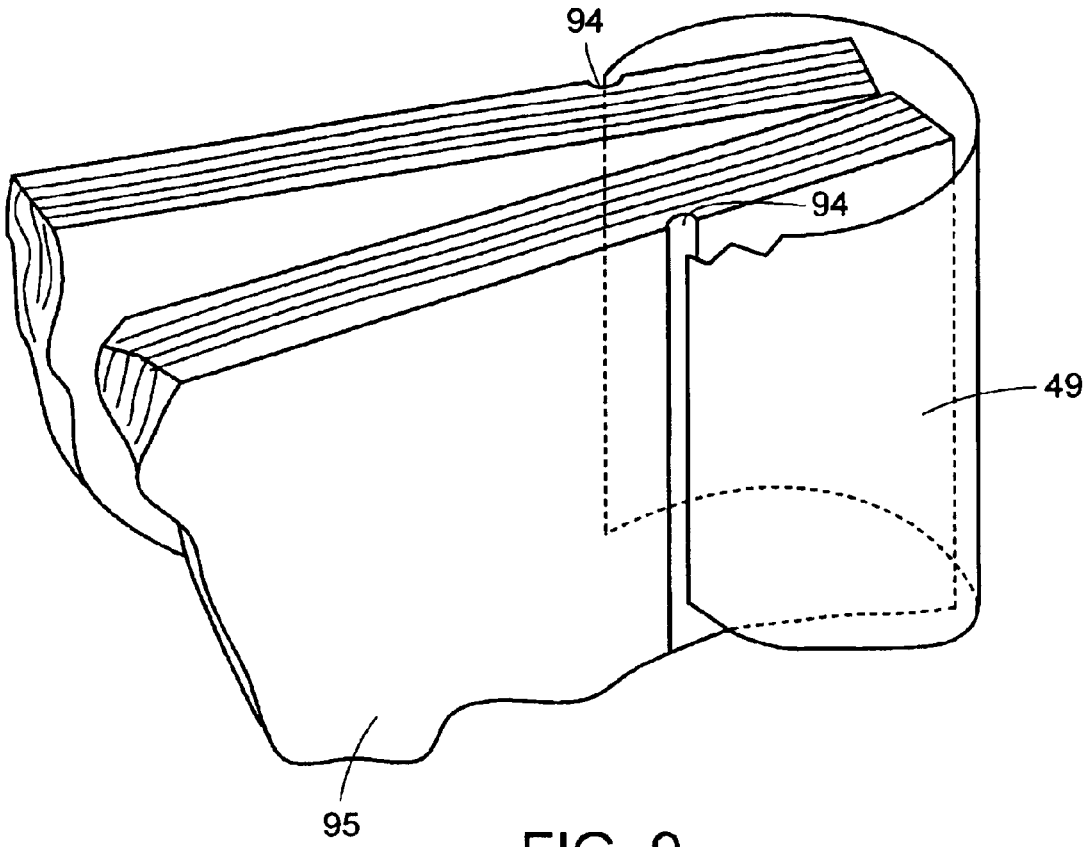
FIG. 9 shows an alternative method of attaching the clamping-tubes to the ends of the panels.
Figure 10:
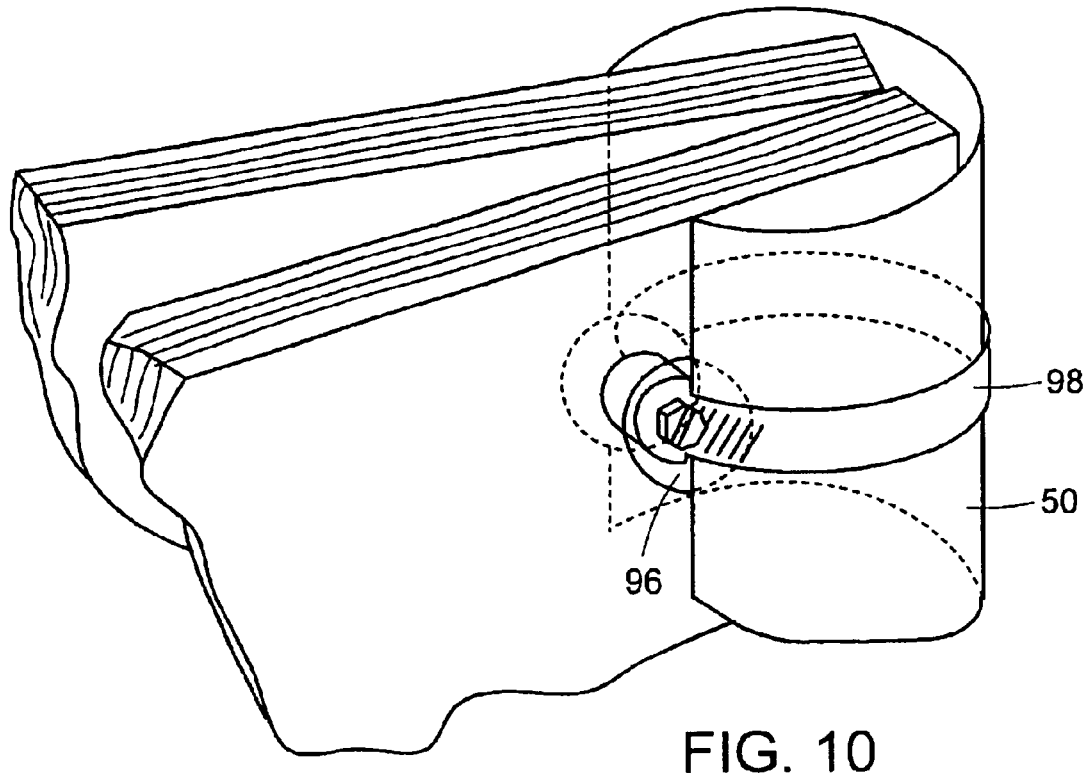
FIG. 10 shows another alternative method of attaching the clamping-tubes to the ends of the panels.

Other ways of attaching the clamping tubes are also envisaged. The method shown in FIG. 9 provides a shallow groove (94) parallel with the end of each climbing panel (95) on the outside surface. The edges of the clamping tube **(48*a*) would then snap into these slots with the outward tension of the arched panels holding it firmly in place. In another scheme, shown in FIG. 10, holes (96) would be drilled through the panels adjacent to the clamping tube (48*b*) and band-clamps (98)** would go through the holes and around the tube to hold the tube in place.

Figure 11:
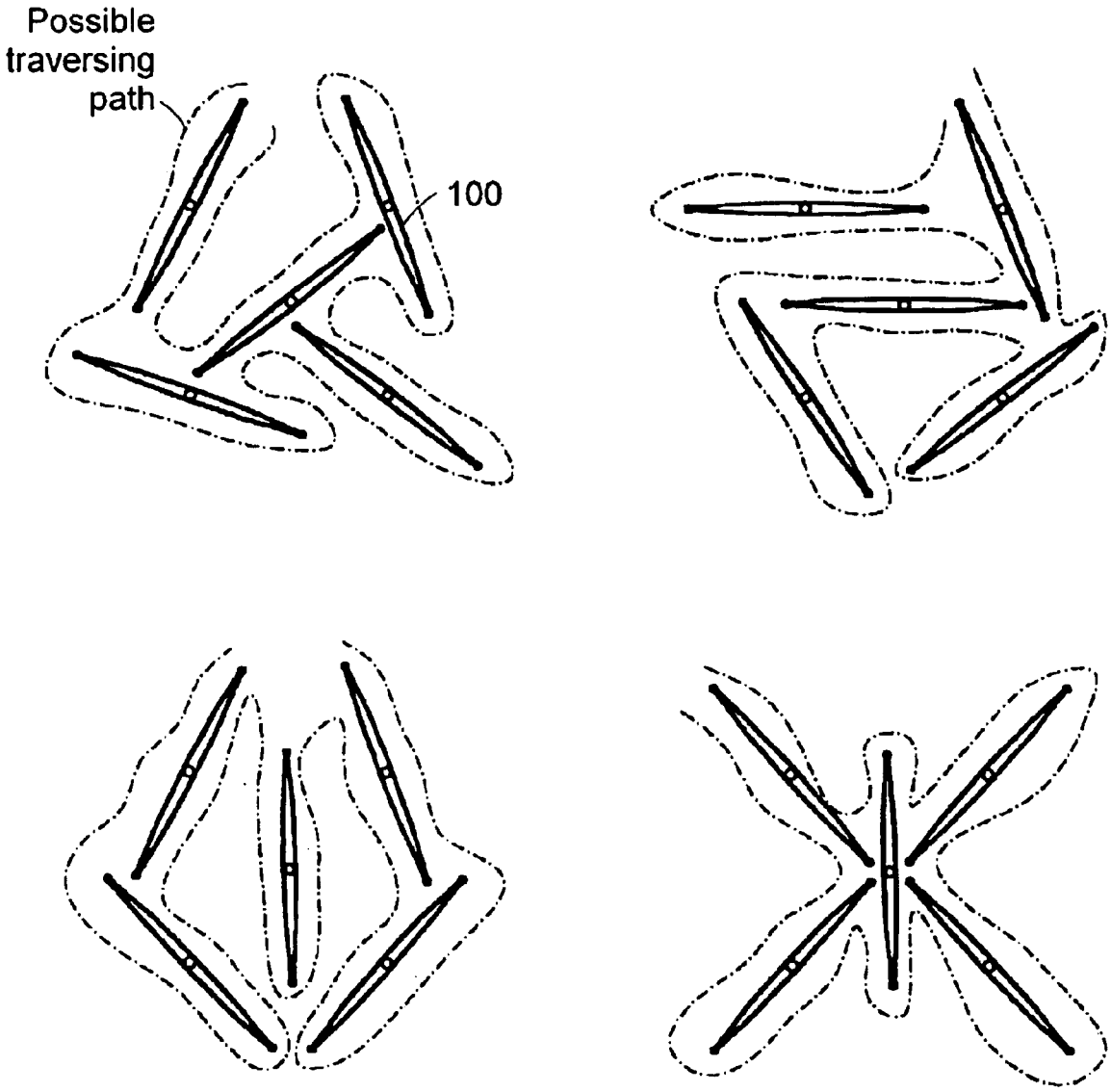
FIG. 11 shows a group of climbing units pictured in several different patterns of orientation.

Although these climbing units can be used as a stand-alone device, they are primarily designed to be installed in groups to provide and interesting and changeable climbing environment FIG. 11 shows several plan views of a group of five climbing units (100). The different views demonstrate how rotating the walls can change the maze-like character of the grouping, offering to the traversing climber a long, convoluted and interesting path.

The foregoing describes a climbing unit with slightly convex walls and attachments to mimic a rock-climbing and traversing environment. Alterations and attachments, however, can provide a variety of different climbing structures. One such structure would be a cantilevered horizontal ladder. Another would be a cantilevered arm for suspending a vertical climbing rope. Such structures could be attached to the panels themselves, or pivotally mounted directly to the support pipe. A horizontal rope may be attached between the tops of the vertical support pipes of two adjacent climbing units to provide an alternative path between the two units. A cantilevered panel disposed at an angle to provide different levels of climbing difficulty may be attached to a support pipe. In short, a variety of traditional or novel climbing apparatuses may be pivotally mounted by this system to provide a changeable climbing environment.

In use, a group of climbing units provides a large and varied climbing area which is suitable for many playground activities such as follow-the-leader, tag, and hide-and-seek as well a general climbing activities. The grouping of the units provides for multiple traversing paths of varying difficulty through the maze-like structure. Pivoting the units to different angles yields a new arrangement of the units which alters both the climbing experience and the appearance of the grouping.

The preceding description contains specific details, but should not be construed to limit the scope of this invention, but rather as an example of a preferred embodiment. Many other variations are possible. For example: the individual climbing units could be mounted to an independent substructure for interior use rather than a concrete foundation; molded panels with rock-like surfaces or panels with attached rungs or other climbing features could be provided; climbing units could be mounted at an angle to the ground to provide different inclinations; the locking rings could be designed to allow limited angular adjustment by the users; and various attachments and alterations to the climbing surfaces not herein described are possible.

Thus, the scope of this invention should be determined by the appended claims and their legal equivalents and not by the embodiments illustrated.

What is claimed is:

1. A climbing unit comprising:

a) a molded panel assembly comprising at least one climbing surface for supporting a person; and b) a pivoting support structure that is attached to the panel assembly, the panel assembly pivoting about an axis of the pivoting support structure that is oriented in a substantially vertical direction so as to provide a changeable climbing environment.

2. The climbing unit of claim 1 wherein the pivoting support structure comprises a locking device that secures the pivoting support structure so that the panel assembly remains stationary while supporting the person when the locking device is activated.

3. The climbing unit of claim 2 wherein the locking device comprises a locking ring.

4. The climbing unit of claim 3 wherein the locking ring secures the pivoting support structure at a plurality of discrete positions.

5. The climbing unit of claim 1 wherein the at least one climbing surface comprises a convex shape that is adapted for climbing.

6. The climbing unit of claim 1 further comprising a first and a second slot clamping tube that are rigidly attached to a first and a second end of the panel assembly, respectively, so that the at least one climbing surface of the panel assembly has a shape that is adapted for climbing.

7. The climbing unit of claim 1 wherein the at least one climbing surface comprises at least one climbing hold.

8. The climbing unit of claim 7 wherein the at least one climbing hold comprises a rocklike protrusion extending from the at least one climbing surface of the panel assembly.

9. The climbing unit of claim 1 wherein the at least one climbing surface comprises a rock-like surface.

10. The climbing unit of claim 1 wherein the at least one climbing surface comprises at least one attached rung.

11. The climbing unit of claim 1 wherein the at least one climbing surface is dimensioned to facilitate traverse climbing.

12. The climbing unit of claim 1 wherein the panel assembly is supported by a tension rod.

13. The climbing unit of claim 1 wherein the axis is positioned substantially proximate to the center of the panel assembly.

14. The climbing unit of claim 1 wherein the pivoting support structure comprises a pipe.

15. The climbing unit of claim 1 further comprising a base plate that is attached to the pivoting support structure.

16. The climbing unit of claim 1 further comprising a foundation that is attached to the pivoting support structure.

17. The climbing unit of claim 16 wherein the foundation comprises concrete.

18. The climbing unit of claim 1 wherein the panel assembly comprises a grab ring.

19. A changeable climbing environment comprising:

a) a plurality of panel assemblies, each of the plurality of panel assemblies being positioned in a group and comprising at least one climbing surface having rock-like protrusions or supporting a person; and b) at least one pivoting support structure that is attached to at least one of the plurality of panel assemblies, the at least one of the plurality of panel assemblies pivoting about an axis of the at least one pivoting support structure that is oriented in a substantially vertical direction so as to provide a changeable climbing environment.

20. The climbing unit of claim 19 wherein the at least one pivoting support structure comprises a locking device that secures the at least one pivoting support structure so that at least one of the plurality of panel assemblies remains stationary when supporting the person when the locking device is activated.

21. The climbing unit of claim 19 wherein at least one of the plurality of panel assemblies is disposed at an angle that is different from another one of the plurality of panel assemblies, thereby creating a climbing unit with at least two climbing inclinations.

22. A climbing unit comprising:

a) a supporting means having at least one climbing surface having rock-like protrusions for supporting a person; and b) a means for pivoting the supporting means about an axis that is oriented in a substantially vertical direction to provide a changeable climbing environment.

23. The climbing unit of claim 22 further comprising a locking means for securing the supporting means.

* * * * *

UNITED STATES PATENT AND TRADEMARK OFFICE

CERTIFICATE OF CORRECTION

PATENT NO. : 6,699,158 B1
DATED : March 2, 2004
INVENTOR(S) : Richardson et al.

It is certified that error appears in the above-identified patent and that said Letters Patent is hereby corrected as shown below:

Column 6,
Line 63, replace “or” with -- for --

Signed and Sealed this

Thirteenth Day of April, 2004

JON W. DUDAS
*Acting Director of the United States Patent and Trademark Office*